US005113764A

United States Patent [19]

Mandigo et al.

[11] Patent Number: 5,113,764

[45] Date of Patent: May 19, 1992

[54] SEMICONDUCTOR BRIDGE (SCB) PACKAGING SYSTEM

[75] Inventors: Frank N. Mandigo, North Branford, Conn.; George C. Mei, Creve Coeur, Mo.; Julius C. Fister, Hamden, Conn.

[73] Assignee: Olin Corporation, New Haven, Conn.

[21] Appl. No.: 699,116

[22] Filed: May 13, 1991

Related U.S. Application Data

[62] Division of Ser. No. 412,252, Sep. 25, 1989, Pat. No. 5,029,529.

[51] Int. Cl.[5] ..... F42C 19/12

[52] U.S. Cl. ..... 102/202.9; 102/202.5

[58] Field of Search ..... 102/202.7, 202.9, 202.5, 102/205, 202.8, 202.14, 218, 220

[56] References Cited

U.S. PATENT DOCUMENTS

| | | | |
|---|---|---|---|
| 3,366,055 | 1/1968 | Hollander, Jr. | 102/202.7 |
| 3,611,939 | 10/1971 | Stadler et al. | 102/202.8 |
| 3,828,677 | 8/1974 | Kaszupski | 102/202.9 |
| 3,867,885 | 2/1975 | Gawlick et al. | 102/202.9 |
| 4,261,263 | 4/1981 | Coultas et al. | 102/202.7 |
| 4,386,567 | 6/1983 | Ciccone et al. | 102/202.5 |
| 4,393,779 | 7/1983 | Brede et al. | 102/202.9 |
| 4,484,523 | 11/1984 | Smith et al. | 102/202.5 |
| 4,644,863 | 2/1987 | Bender et al. | 102/202.5 |
| 4,690,056 | 9/1987 | Brede et al. | 102/202.5 |
| 4,708,060 | 11/1987 | Bickes et al. | 102/202.7 |
| 4,729,315 | 3/1988 | Proffit et al. | 102/202.9 |
| 4,819,560 | 4/1989 | Patz et al. | 102/202.5 |
| 4,831,933 | 5/1989 | Nerheim | 102/202.9 |

FOREIGN PATENT DOCUMENTS

| | | |
|---|---|---|
| 3308635 | 3/1983 | Fed. Rep. of Germany . |
| 3537820 | 10/1985 | Fed. Rep. of Germany . |
| 960186 | 6/1964 | United Kingdom . |

OTHER PUBLICATIONS

Bickles, Jr. "Semiconductor Bridge (SCB) Development Transfer Symposium" prepared by Sandia National Laboratories, unlimited release as SAND86-221-1.UC-13 printed Jan. 1987, pp. 1-146 (Sandia Report).

New York Times, Feb. 12 1989 "Defense Radar must Turn Off As Planes Land".

*Primary Examiner*—Stephen Johnson

*Attorney, Agent, or Firm*—Gregory S. Rosenblatt; Paul Weinstein

[57] ABSTRACT

The present invention is direct to primer housings to secure a semiconductor bridge device in close proximity to an energetic charge. The primar housings are formed from an electrically conductive alloy and contain a dielectric medium disposed between components to maintain electrical isolation. The housings are characterized by high ductility to resist fracture during assembly or handling. In certain embodiments, one or both lead wires are removed to reduce the potential for lead wire breakage or separation.

25 Claims, 3 Drawing Sheets

SEMICONDUCTOR BRIDGE (SCB) PACKAGING SYSTEM

"This application is a division of application Ser. No. 07/412,252, filed Sep. 25, 1989, now U.S. Pat. No. 5,029,529."

The present invention relates to a metal package for housing a semiconductor device. More particularly, the invention relates to a cup shaped package for housing a semiconductor bridge (SCB) initiator circuit in close proximity to an explosive medium.

Military weapon systems are typically activated by a primer system. The primer usually employs a small metal bridgewire to ignite a contained explosive mixture. An electric current typically in the range of from about 3 amps to about 5 amps is passed through the bridgewire. Internal resistance heats the bridgewire to a temperature in excess of about 900° K. The hot bridgewire ignites an energetic powder,, triggering the primer which in turn ignites the primary system. The system may incorporate a pyrotechnic mixture for use as a flare or tracer, a propellant or an explosive powder.

In addition, bridgewire initiated primer systems find application outside the military. The systems are employed in the automotive industry to inflate automotive airbags upon impact.

A problem with the bridgewire type primer is a sensitivity to externally generated electric circuits. High levels of electromagnetic energy from sources such as radio waves, static electricity, lightning or radar may induce an electric current within the bridgewire sufficient to cause an undesired, premature ignition. The problem is sufficiently serious that certain radar installations must be deactivated while military aircraft land. As disclosed in the New York Times (Feb. 23, 1989), the emissions from the radar are believed capable of initiating an accidental detonation.

A solution to the induced current problem encountered in bridgewire type initiator is disclosed in U.S. Pat. No. 4,708,060 to Bickes, Jr. et al and in Sandia National Labs Report No. SAND 86-2211 edited by Bickes, Jr. Both of which are incorporated herein by reference. A semiconductor bridge circuit will initiate the explosive reaction within the primer when a current is applied. The SCB circuit is significantly less susceptible to induced electric currents and the resultant possibility of accidental or premature ignition is reduced.

A semiconductor bridge circuit comprises a circuit formed on a semiconductor material such as silicon or gallium arsenide. A heavily doped region of an n-type dopant such as phosphorous is vaporized when a current of sufficient amperage is applied. The silicon vapor is electrically heated and permeates the adjacent energetic powder mixture. Through localized convection and condensation, the energetic powder is heated to its ignition temperature leading to the desired explosive reaction being initiated.

The advantages of the SCB type initiator over the bridgewire include lower voltage requirements, less susceptibility to accidental or premature initiation and more rapid firing times. However, to the best knowledge of the inventors, there has not yet been developed a satisfactory means to house an SCB circuit.

The SCB circuit is formed on a brittle semiconductor substrate. The package housing the device must provide both mechanical and environmental protection to the device. The components making up the electronic package must also be compatible with the SCB device, the energetic powder and the remainder of the explosive system.

Presently the device is mounted on a ceramic header containing KOVAR feed through pins. Aluminum or gold wires electrically interconnect the feed throughs to bonding sites on the semiconductor device. The package is not a preferred structure. The ceramic header is brittle and may not withstand rough handling. The wire bonds have a high profile and may break due to stresses resulting from contact with the powder. Forming ceramic headers with metal feed throughs is a relatively expensive process adding to the cost of the device. Also, the profile of the feed throughs is not compatible with the wiping device used to activate the primer thereby firing the weapon.

Therefore, in accordance with the invention, there is provided an electronic package primer incorporating a semiconductor bridge type initiator circuit which does not have the disadvantages of a ceramic header type package. It is an advantage of the present advantage that the package components are manufactured from metal and may be readily formed into shape by conventional mechanical processes such as deep drawing, coining, cupping and stamping. It is another advantage of the invention that in one embodiment of the invention the leadwire lengths are reduced and in a second embodiment the leadwires are eliminated minimizing the potential for lead breakage and subsequent device failure. Yet another advantage of the electronic packages of the invention is that ductile components are employed increasing the resistance of the primer package to mechanical damage. It is a feature of the invention that the package components may be coated with a corrosion resistant material to minimize package degradation due to exposure to hostile environments or to the energetic powder.

Accordingly, there is provided a metal or metal alloy primer housing adapted to secure a semiconductor bridge circuit in close proximity to an energetic medium. The housing comprises a primer cup having an aperture in the base, a primer button is positioned within the aperture. An electrically conductive washer is electrically interconnected to an interior sidewall of the primer cup. A dielectric medium electrically isolates the primer button from both the housing and from the conductive washer. A means is provided to electrically interconnect the SCB to both the primer button and to the housing.

The above-stated objects, features and advantages of the invention as well as others will become apparent to those skilled in the art from the specification and accompanying figures which follow wherein primed reference numerals indicate components which are substantially the same as the components identified by the same unprimed reference numerals.

Figure 1:
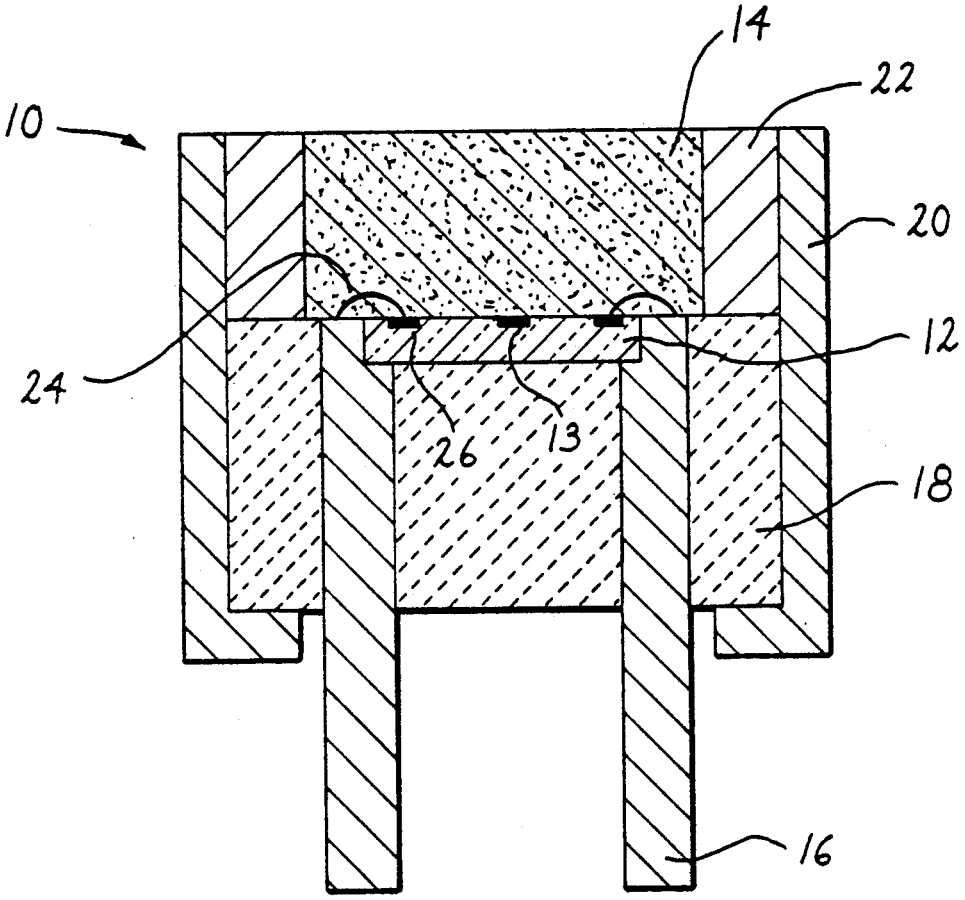
FIG-1 (PRIOR ART)
FIG. 1 illustrates in cross-sectional representation an electronic package for housing a semiconductor bridge type circuit as known in the prior art.

FIG. 1 shows in cross-sectional representation a primer housing 10 for a semiconductor bridge circuit 12 as known in the prior art. The housing 10 encases a semiconductor device 12 formed from a semiconductor material such as silicon or gallium arsenide. The SCB device includes a heavily doped bridge 13 which vaporizes when a threshold current is applied. The primer housing 10 positions the bridge 13 in close proximity to a charge 14 of an energetic powder such as lead azide. The primer housing 10 comprises a pair of metallic feed through leads 16 which pass through a ceramic header 18. A conventional glass to metal seal bonds the feed through leads 16 to the header 18.

A metallic casing 20 made, for example, of aluminum surrounds the ceramic header 18 and a charge holder 22. The casing 20 provides support for the primer housing 10 and also provides a mechanism whereby the device may be inserted into a weapon or other explosive device.

Wire bonds 24 electrically interconnect the metal feed through leads 16 to bond pads 26 formed on a surface of the semiconductor bridge device 12. When a voltage is applied across feed through leads 16, current flows through the bridge 13. The bridge vaporizes forming a plasma cloud within the energetic particles 14. The electric current further heats the plasma vapor such that local convection and condensation heat the energetic particles 14 to ignition. The entire process from application of voltage to ignition takes place in less than about 400 micro-seconds.

Two problems with the primer housing 10 of the prior art are the ceramic header 18 is brittle and subject to fracture when the explosive device is handled roughly and the wire bonds 24 are in contact with the primer charge 14. The primer charge is compacted to maximize the explosive energy. Compaction of the powder 14 applies stresses to the wire bonds 24 potentially leading to the wires either breaking or pulling loose from either the feed through leads 16 or from the bond pads 26.

As will be disclosed hereinbelow, the inventors' package does not have these problems and provides a rugged package for encasing the semiconductor bridge initiator circuit.

Figure 2:
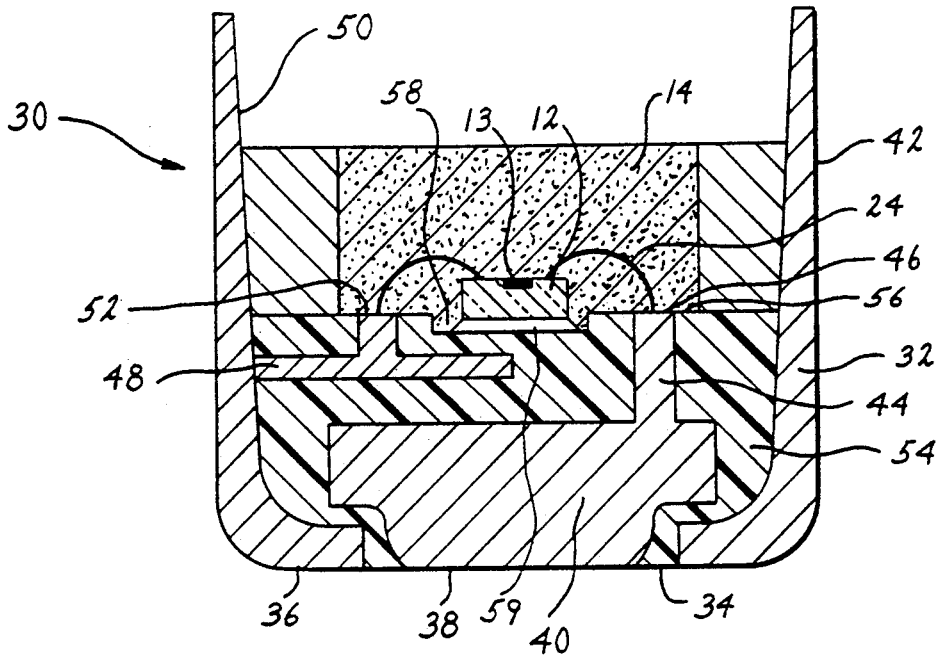
FIG. 2 illustrates in cross-sectional representation an electronic package for housing an SCB circuit in accordance with a first embodiment of the invention.

FIG. 2 illustrates in cross-sectional representation a primer housing 30 adapted to house a semiconductor bridge device 12 in accordance with a first embodiment of the invention. The housing 30 comprises a primer cup 32 which is manufactured from any ductile material. The material selected for the primer cup 32 should also be easy to mechanically work and a good conductor of electricity. Preferably the primer cup 32 is manufactured from copper or a copper based alloy such as brass. A preferred brass from a manufacturing as well as electrical standpoint is C 260, also known as cartridge brass, having a nominal composition of 70% by weight copper and 30% by weight zinc.

The primer cup 32 is formed by machining or a mechanical process such as deep drawing or cupping. In deep drawing, a flat sheet of metal is shaped into a cylindrical part by means of a punch which presses the sheet into a die cavity. Either during the primer cup 32 forming operation or as a subsequent step, an aperture 34 is formed in the base 36 of the primer cup 32. The diameter of the aperture 34 is selected so that the strength of the primer cup 32 is not unduly weakened. However, the diameter of the aperture 34 must be large enough to permit the contact portion 38 of a primer button 40 to be centered within the aperture 34. While the diameter of the aperture may vary, a diameter of from about $\frac{1}{3}$ to about $\frac{2}{3}$ the overall diameter of the primer base 36 is preferred.

The external sidewalls 42 of the primer cup 32 may be tapered or threaded or otherwise adapted to facilitate insertion and attachment into an explosive device.

The primer button 40 transmits the electrical current necessary to vaporize the bridge 13 igniting the energetic charge 14. The primer button 40 is preferably given a positive electric charge, i.e. serves as the anode, so that the primer cup 32 and explosive device serve as a ground.

The primer button 40 is either machined or cast. The button 40 is formed from a good electrical conductor, such as copper, aluminum or an alloy based on one of those metals. Alternatively, an alloy with a coefficient of thermal expansion approximately matching the coefficient of thermal expansion of the SCB bridge device 12 may be employed. Such materials include iron-nickel alloys such as Alloy-42 (nominal composition by weight 41% nickel and 59% by weight iron) or Kovar (trademark for an iron-nickel-cobalt alloy). Preferably, the primer button is manufactured from a high performance copper alloy such as C194 (nominal composition by weight 97.5% copper, 2.35% iron, 0.03% phosphorous and 0.12% zinc) The terminal end 46 of the first contact post 44 extends outwardly from the primer button 40. The terminal end 46 of the first contact post 44 is either ground or polished to a relatively flat finish. The terminal end 46 receives the end of the wire bond 24 opposite the semiconductor bridge device 12.

A washer 48 is manufactured from any electrically conductive, easily machined material which is compatible with the material selected for the primer cup. One exemplary choice is copper alloy C194. The washer 48 is bonded to the interior sidewalls 50 of the primer cup 32. The washer 48 may be circular and bonded around its entire diameter or pie shaped constituting an arc extending less than 360° about the interior sidewalls 50 as shown in FIG. 2.

The washer 48 may be press fit and held by friction to the interior sidewalls 50 of the primer cup 32. Alternatively, a conductive adhesive or a suitable solder or braze such as 60% by weight tin -40% by weight lead bonds the washer 48 to the interior sidewalls 50. The washer 48 further includes a second contact post 52 for electrical interconnection to the wire bond 24 emanating from the SCB device 12. The current flow through the primer cup 30 originates at the primer button 40, flows through the first contact post 44, through the wire bond 24 to the SCB device 12, across the bridge 13 and to ground via the second contact post 52, washer 48 and the primer cup 32.

While air is a good dielectric and maintains electrical isolation between the primer button 40 and the washer 48, it is preferable to insert a dielectric material 54 between the primer button 40 and washer 48 to minimize the possibility of an electrical short circuit should the primer housing 30 be jostled and subjected to bending stresses. Any dielectric material which may be inserted in liquid, powder or gel form and which subsequently hardens to a solid may be employed.

Polymers, glasses and ceramics are all suitable dielectrics. Polymers are preferred due to their inherent flexibility. Preferred polymers include vinyls and epoxies. A most preferred polymer is an electronic grade epoxy having low levels of ionic contamination.

The bonding surface 56 of the dielectric 54 may be flat or contain a recess 58 adapted to receive the SCB device 12. A recess 58 is preferred so that the bonding sites on the SCB device 12 are approximately on the same vertical level as the first 44 and second 52 bonding posts. The closer the vertical proximity of the bond attach pads and the bonding posts, the shorter the wire bonds 24. Shorter wire bonds reduce the risk or wire bond breakage during packing of the energetic charge 14 or during subsequent handling.

A die attach material 59 bonds the SCB device 12 to the dielectric layer 54. Since the substrate is a dielectric, the die attach may be any compliant adhesive such as an epoxy.

The housing 30 of FIG. 2 solves one of the problems of the prior art SCB packages. The ceramic header has been eliminated and the package is formed of ductile materials so that the package is better able to withstand the rigors of military or aerospace applications. Further, when the housing is manufactured from copper, aluminum or alloys thereof, the components are significantly less expensive and easier to machine than when the low expansion alloys compatible with the ceramic header are utilized. The package 30 still contains relatively long wire bonds and device failure due to wire bond breakage or separation may still be a problem.

Figure 3:
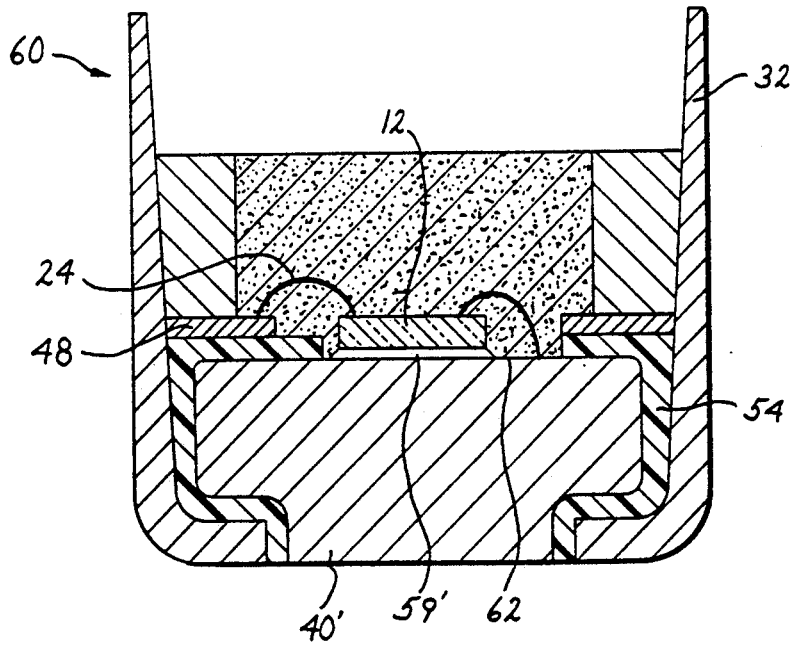
FIG. 3 illustrates in cross-sectional representation an electronic package for housing an SCB circuit in accordance with a second embodiment of the invention.

The primer housing 60 illustrated in cross-section in FIG. 3 represents a second embodiment of the invention. In housing 60, the primer button 40' is formed with a flat bonding surface 62 to receive the SCB device 12. Wire bond 24 electrically interconnects the SCB device 12 directly to the primer button 40'. The positioning of the bonding surface 62 of the primer button 40' and the washer 48 is such that the bond pads of the SCB device 12 are at the same height as the washer 48. In this way, the length of the bond wires 24 is minimized. Further, since the primer button is a simple shape, lacking contact posts, the button 40' may be formed by a mechanical process such as closed die forging. Mechanical processes are usually less expensive, quicker and generate less metal scrap as compared to machining or other techniques used to form the primer button 40 of FIG. 2.

Other than the design of the primer button 40', the housing 60 is formed according to the process described above for the housing 30. The washer 48 is press fit, soldered, brazed or adhesively bonded into place. An electrical pulse is passed through the primer button 40', the SCB device 12 and grounded through the primer cup 32. A dielectric matter 54, preferably a polymer, electrically isolates the primer cup 32 from the primer button 40'.

The SCB device 12 is bonded to the primer button 40' by any compliant means 59' known in the die attach industry. Either a dielectric adhesive, an electrically conductive soft solder or a buffered die attach system may be employed. Further, if the button 40' is manufactured from an alloy having a relatively low coefficient of thermal expansion such as Kovar, standard eutectic die attach materials such as gold-silicon or gold-tin may be used.

While the embodiment of FIG. 3 has shorter lead lengths and a simplified design over the previous package embodiment, lead wires 24 are still required and the potential for lead wire breakage resulting in device failure is still present. The following Example will illustrate the difficulty with ground leads and highlight the improvement obtained with the single lead and leadless primer housings disclosed hereinbelow.

EXAMPLE

Twenty seven SCB primer housings manufactured according to the embodiment illustrated in FIG. 3 were produced. When packed with an energetic charge, seven of the units lost conductance indicating lead wire failure. Those which did not have wire failure had low internal resistance and successfully fired upon the application of a threshold voltage.

Lead wire failure after packing with the energetic charge may be easily determined by measuring the resistance through the SCB device. The defective primers may be removed. Alternatively, the method of packing the charge may be adapted to lessen lead stresses. However, in accordance with the invention, the inventors have developed a primer housing incorporating either a single lead or no leads to reduce or remove the problem of lead wire failure.

Figure 4:
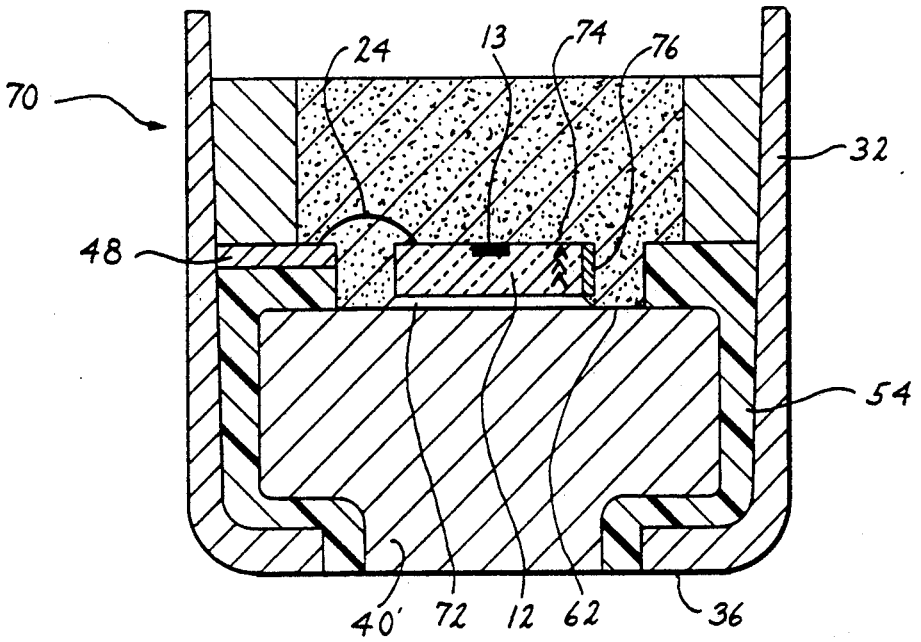
FIG. 4 illustrates in cross-sectional representation a package for housing an SCB circuit which requires a single bond wire in accordance with an embodiment of the invention.
Figure 5:
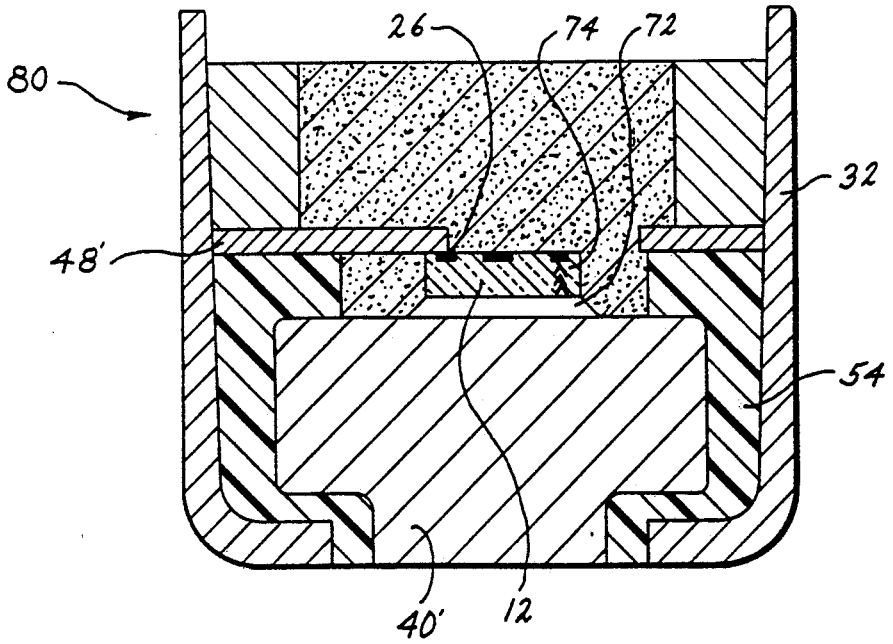
FIG. 5 illustrates in cross-sectional representation a package for housing an SCB circuit which does not require any bond wires in accordance with yet another embodiment of the invention.

FIGS. 4 and 5 illustrate other package embodiments which eliminate one or both lead wires and retain the strength, ductility and ease of manufacture of the above-described package designs.

FIG. 4 illustrates in cross sectional representation a primer housing 70 for housing an SCB device 12 employing a single wire bond lead 24. The primer button 40' is shaped essentially as described for the housing 60 hereinabove. The button 40' is manufactured from a copper, aluminum or alloys thereof or a low expansion alloy as discussed hereinabove. An aluminum based alloy such as AA1100 (commercially pure aluminum having a nominal composition of at least 99.00% by weight aluminum) is preferred to facilitate wire bonding to the button 40'. The bonding surface 62 of the primer button 40' is ground flat and parallel to the base 36 of the primer cup 32. The SCB device 12 is bonded to the bonding surface 62 by a die attach means 72. The die attach means is any electrically conductive bonding medium known in the art. Since the primer button 40' is preferably manufactured from a copper based alloy having a coefficient of thermal expansion significantly higher than the coefficient of thermal expansion of the silicon based SCB device 12, a buffered or compliant die attach system is preferred. Examples of a compliant die attach system include a silver filled epoxy and a soft solder such as a lead-tin-indium alloy. A buffer system typically employs a molybdenum or tungsten wafer disposed between and soldered to the copper alloy primer button 40' and the SCB device 12. The die attach system 72 should be electrically conductive so that the current pulse passing through the primer button 40' will be transmitted through the die attach 72.

The current pulse is conducted from the die attach 72 to the bridge 13 by one of several embodiments of the invention. The electrical pulse may follow a conductive path 74 through the silicon based device 12. A conductive path 74 may be formed by controlled doping of the silicon wafer during the manufacture of the semiconductor bridge device 12. By the use of proper masking and selection of dopants, a conductive path capable of conducting the requisite current may be formed.

The size and geometry of the conductive path 74 is dependent on the current carrying capability required. Multiple channels may also be employed. It is believed a channel or plurality of channels each having a diameter of from about 1 mil to several hundred mils would be capable of carrying from about a few milliamps to up to about 20 amps.

The conductive path 74 is formed by doping the desired regions of the semiconductor bridge device 12. For relatively high current applications such as desired for effective operation of the semiconductor bridge device, relatively heavy doping is required. A dopant concentration of about $7\times10^{19}$ phosphorous atoms/$cm^3$ has been found suitable for current requirements in the range of about 3 to about 5 amps. Lower phosphorous concentrations may be employed if lower amperages will be employed. The use of phosphorous as a dopant is intended to be exemplary, other suitable dopants may be substituted.

Alternatively, an external conductive path 76 may be utilized. At least one edge of the semiconductor device 12 is metallized with a conductive medium such as gold or silver. A barrier layer such as nickel or palladium may be deposited between the conductive layer and the metallization layer to minimize diffusion of the conductive metal into the semiconductor device. The metallization 76 extends from the base of the semiconductor device 12 where it is in contact with the electrically conductive die attach 72 along the edge of the device 12 to a bonding pad 26 which is electrically interconnected to the SCB device 12 as described hereinabove.

In accordance with these embodiments, one of the bond wires 24 has been eliminated, essentially reducing the danger of bond wire breakage and device failure by a factor of two.

To minimize the potential of damage to the remaining bond wire 24, the wire may be coated with an epoxy or other protective sealant. The coating will impart additional strength to the bond wires and minimize corrosion or other degradation of the wires which are typically aluminum, gold, copper or alloys thereof. Alternatively, the lead may be replaced with a metal foil lead of the type employed for tape automated bonding (TAB). TAB leads comprise a beam type metal foil layer extending in cantilever fashion between the washer 48 and the bonding sites 26 of the SCB circuit 12. The TAB lead may comprise a single metal foil layer having a cross sectional area of about 2 mils square. Preferably, the TAB lead also includes a dielectric carrier layer such as a polyimide which may be laminated directly to the metal foil or bonded to the metal foil by an adhesive. The two or three layer TAB leads have the added strength and flexibility of the polyimide layer to decrease the likelihood of lead breakage.

In accordance with the invention, both coated leads and TAB leads may be employed with any embodiment requiring bond wires 24. Further, any primer housing embodiment which may be apparent to one skilled in the art from this specification may also incorporate either coated bond wires or TAB leads.

FIG. 5 shows in cross sectional representation a primer housing 80 adapted to house an SCB device 12 in accordance with yet another embodiment of the invention. As with the previous embodiments, a copper or copper alloy primer cup 32 houses the device 12. A primer button 40' is mounted within the primer cup 32 and electrically isolated from it. The SCB device 12 is bonded to the primer button 40' by an electrically conductive die attach system. As disclosed hereinabove, the die attach system is preferably either compliant or buffered to minimize thermally induced mechanical stresses generated by the coefficient of thermal expansion mismatch between the device 12 and the primer button 40'.

A conductive channel 74 is formed within the semiconductor bridge device 12 to electrically interconnect the SCB circuitry with the back side of the semiconductor die. Alternatively, an external conductive path as disclosed hereinabove may be employed.

The washer 48' is sufficiently long to make contact with the bond site 26 of the SCB device. Contact may be mechanical. The washer 48' is preferentially manufactured from a copper base alloy having a spring temper such as C194 or C195 (nominal composition by weight 97% copper, 1.5% iron, 0.1% phosphorous, 0.8% cobalt and 0.6% tin). Alternatively, silver or gold plated C260, possibly including a diffusion barrier layer such as nickel may be employed. By imparting a temper in the washer 48', positive spring tension may be maintained on the bond pad 26. The spring tension maintains sufficiently low resistivity to permit acceptable operation of the device 12. To improve electrical conductivity, a soft metallization such as gold or silver may be applied to the bond site 26. Alternatively, a solder preform may be disposed between the washer 48' and the bond site 26 to minimize interfacial resistivity. Also, the bond pads 26, may be formed with a bump to increase the contact pressure.

Accordingly, any of the previously mentioned primer cup, primer button, or conductive washer could be made of copper, aluminum, alloys thereof, or an iron-nickel base alloy.

The embodiment illustrated by FIG. 5 has significant advantages over the prior art packages used to house SCB type devices. The housing 80 is comprised solely of metal and a polymer dielectric 54. The absence of a ceramic header reduces the danger of package fracture during handling or due to thermally induced mechanical stresses. The absence of bond wires eliminates the danger of bond wire breakage or separation form a bonding site and the resultant device failure.

The patents and publications set forth in this application are intended to be incorporated in their entirety herein.

It is apparent that there has been provided in accordance with the present invention a primer housing adapted to house a semiconductor bridge circuit which fully satisfies the objects, means and advantages set forth hereinabove. While the invention has been described in combination with the embodiments thereof, it is evident that may alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A primer housing for a semiconductor bridge device, comprising:

a primer cup having a base and sidewalls with an aperture formed in said base;

a primer button located within said aperture and electrically isolated from said primer cup;

an electrical conductive washer contacting a bonding site on said semiconductor bridge device and being in electrical contact with both said semiconductor bridge device and an interior surface of said sidewalls;

said primer cup, primer button, and electrically conductive washer individually selected from the group consisting of copper, aluminum, copper alloys, aluminum alloys andiron-nickel alloys;

an electrically conductive compliant die attach material both bonding and electrically interconnecting said semiconductor bridge device to said primer button; and a dielectric material selected from the group consisting of polymers, ceramics and glasses disposed between said primer button and said primer cup.

2. The primer housing of claim 1 wherein said washer is formed from a copper alloy having a spring temper and is maintained in electrical contact with said semiconductor bridge device by spring tension.

3. The primer housing of claim 2 wherein said semiconductor bridge device includes bumps on the bonding site which contacts said washer.

4. The primer housing of claim 3 wherein a gold metallization layer is deposited on said bonding site to reduce electrical resistivity.

5. The primer housing of claim 3 wherein a silver metallization layer is deposited on said bonding site to reduce electrical resistivity.

6. The primer housing of claim 2 wherein a gold metallization layer is deposited on said bonding site to reduce electrical resistivity.

7. The primer housing of claim 2 wherein a silver metallization layer is deposited on said bonding site to reduce electrical resistivity.

8. The primer housing of claim 2 wherein said copper alloy washer is selected from the group consisting of copper alloys C194, C195 and C260.

9. The primer housing of claim 8 wherein said washer is silver plated copper alloy C260.

10. The primer housing of claim 9 wherein a nickel diffusion layer is disposed between said copper alloy C260 washer and said silver plating.

11. The primer housing of claim 8 wherein said washer is gold plated copper alloy C260.

12. The primer housing of claim 11 wherein a nickel diffusion layer is disposed between said gold plating and said copper alloy C260 washer.

13. The primer housing of claim 1 wherein said washer is maintained in electrical contact with said semiconductor bridge device by soldering to said bonding site.

14. A primer housing for a semiconductor bridge device, comprising:

a primer cup having a base and sidewalls with an aperture formed in said base;

a primer button located within said aperture and electrically isolated from said primer cup;

an electrical conductive washer contacting a bonding site on said semiconductor bridge device and being in electrical contact with both said semiconductor bridge device and an interior surface of said sidewalls;

said primer cup, primer button, and electrically conductive washer individually selected from the group consisting of copper, aluminum, copper alloys, aluminum alloys and iron-nickel alloys;

an electrically conductive buffered die attach material, both bonding and electrically interconnecting said semiconductor bridge device to said primer button; and a dielectric material selected from the group consisting of polymers, ceramics and glasses disposed between said primer button and said primer cup.

15. The primer housing of claim 14 wherein said washer is formed from a copper alloy having a spring temper and is maintained in electrical contact with said semiconductor bridge device by spring tension.

16. The primer housing of claim 15 wherein said semiconductor bridge device includes bumps on the bonding site which contacts said washer.

17. The primer housing of claim 16 wherein a gold metallization layer is deposited on said bonding site to reduce electrical resistivity.

18. The primer housing of claim 16 wherein a silver metallization layer is deposited on said bonding site to reduce electrical resistivity.

19. The primer housing of claim 15 wherein a gold metallization layer is deposited on said bonding site to reduce electrical resistivity.

20. The primer housing of claim 15 wherein a silver metallization layer is deposited on said bonding site to reduce electrical resistivity.

21. The primer housing of claim 15 wherein said copper alloy washer is selected from the group consisting of copper alloys C194, C195 and C260.

22. The primer housing of claim 21 wherein said washer is silver plated copper alloy C260.

23. The primer housing of claim 22 wherein a nickel diffusion layer is disposed between said copper alloy C260 washer and said silver plating.

24. The primer housing of claim 21 wherein said washer is gold plated copper alloy C260.

25. The primer housing of claim 24 wherein a nickel diffusion layer is disposed between said gold plating and said copper alloy C260 washer.

* * * * *